US008020331B2

(12) United States Patent
Martin et al.

(10) Patent No.: US 8,020,331 B2
(45) Date of Patent: Sep. 20, 2011

(54) LINEAR BOLT MECHANISM FOR A GUN

(75) Inventors: James Martin, Walworth, NY (US); David Snyder, Palmyra, NY (US)

(73) Assignee: Crosman Corporation, Bloomfield, NY (US)

( * ) Notice: Subject to any disclaimer, the term of this patent is extended or adjusted under 35 U.S.C. 154(b) by 197 days.

(21) Appl. No.: 12/400,372

(22) Filed: Mar. 9, 2009

(65) Prior Publication Data

US 2010/0223830 A1 Sep. 9, 2010

(51) Int. Cl.
*F41A 3/12* (2006.01)

(52) U.S. Cl. ..... 42/69.02

(58) Field of Classification Search ..... 42/16, 69.02; 89/186, 187.01, 187.02
See application file for complete search history.

(56) References Cited

U.S. PATENT DOCUMENTS 3,566,745 A * 3/1971 Jauch et al. ..... 89/187.02
3,653,140 A 4/1972 Alday
3,848,510 A 11/1974 Wolpert
4,922,640 A 5/1990 Toombs
5,447,092 A 9/1995 Dobbins
5,518,335 A 5/1996 Dobbins
5,682,007 A * 10/1997 Dobbins ..... 89/187.02
6,393,961 B1 5/2002 Ockenfuss
6,418,655 B1 * 7/2002 Kay ..... 42/75.02
6,513,273 B2 * 2/2003 da Silveira ..... 42/70.08
6,904,902 B2 6/2005 Axelsson
7,107,715 B2 9/2006 Keeney et al.
7,219,461 B1 5/2007 Keeney et al.
7,299,737 B2 11/2007 Hajjar et al.

* cited by examiner

*Primary Examiner* — Bret Hayes
(74) *Attorney, Agent, or Firm* — Brian B. Shaw, Esq.; Stephen B. Salal, Esq.; Harter Secrest & Emery LLP

(57) ABSTRACT

A linear bolt mechanism for a gun is provided, wherein a bolt moves between a firing position and an open position through linear motion, without requiring rotation of the bolt. The bolt includes a seating socket which engages a locking pin to permit travel of the bolt upon disposing the locking pin in a traveling position. The seating socket also engages the locking pin when the locking pin engages the locking socket, thereby precluding movement of the bolt with the locking pin in the locking position.

20 Claims, 6 Drawing Sheets

FIGURE 1
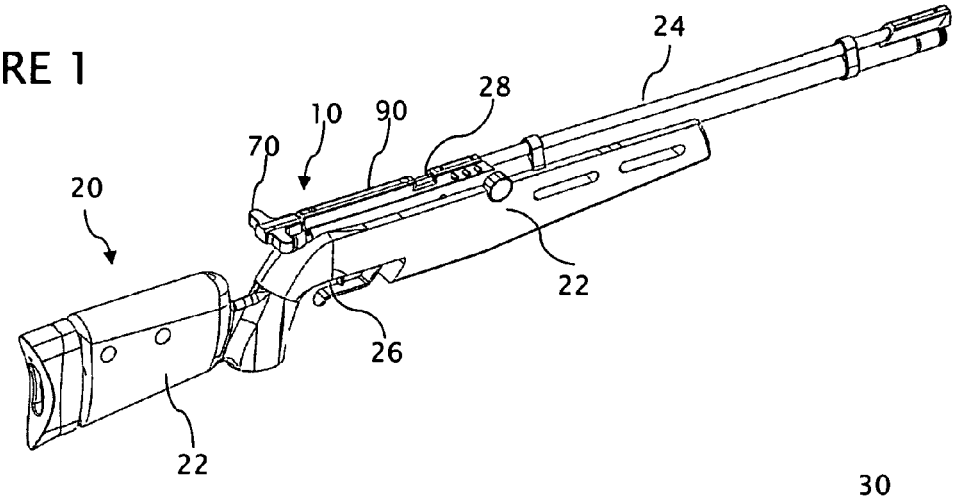
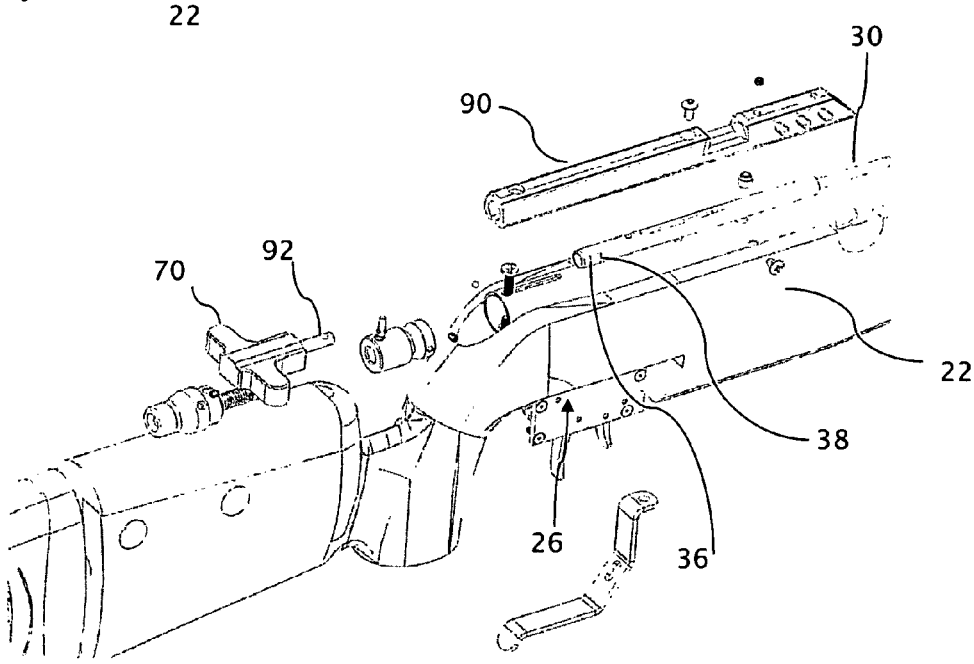
FIGURE 2

FIGURE 3
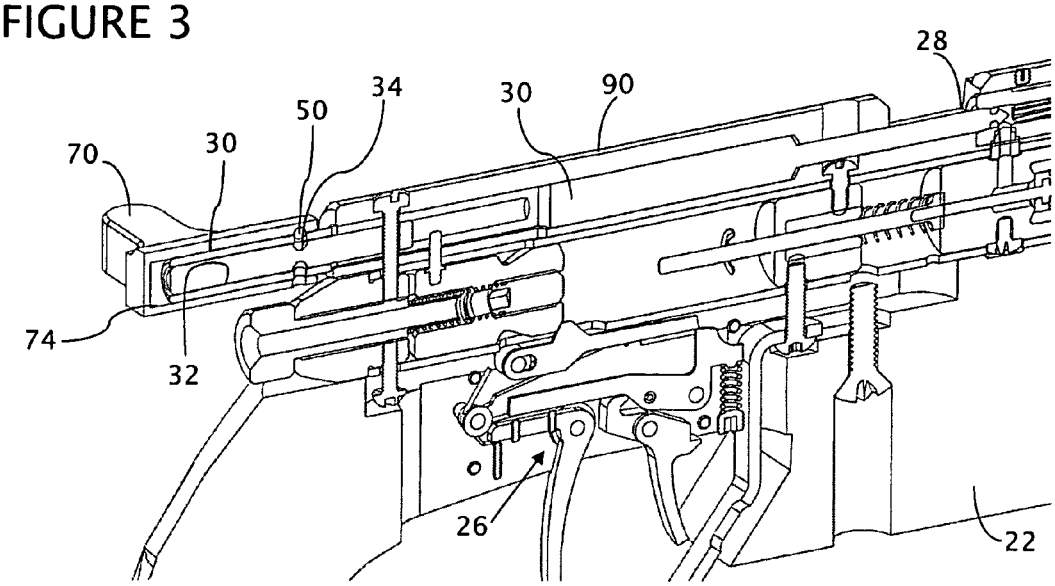
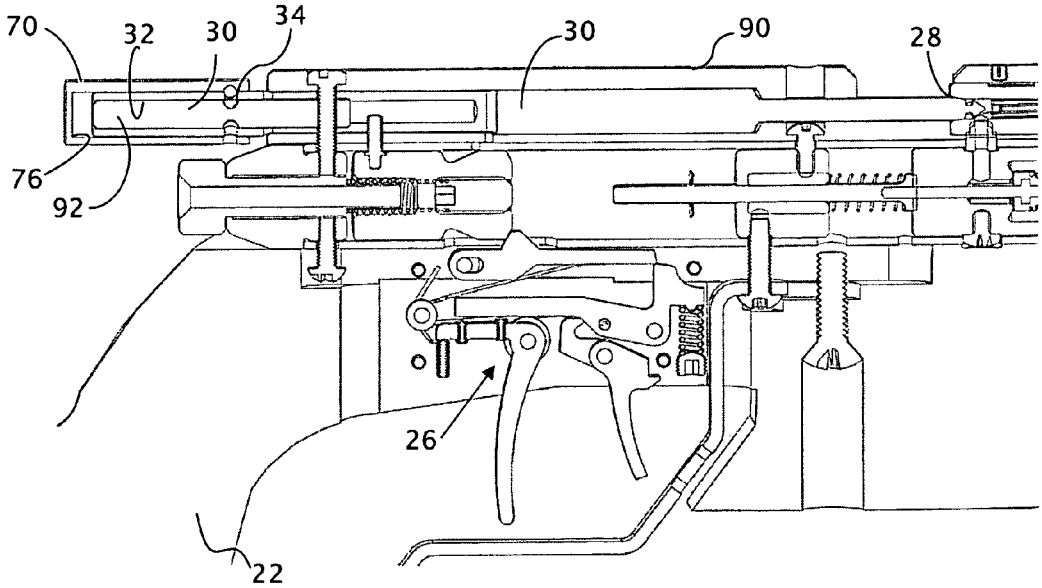
FIGURE 4

FIGURE 5
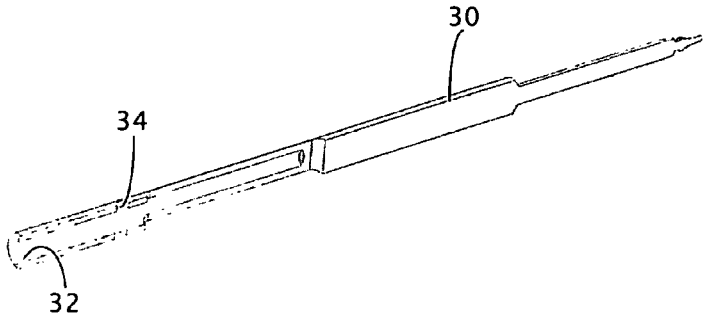
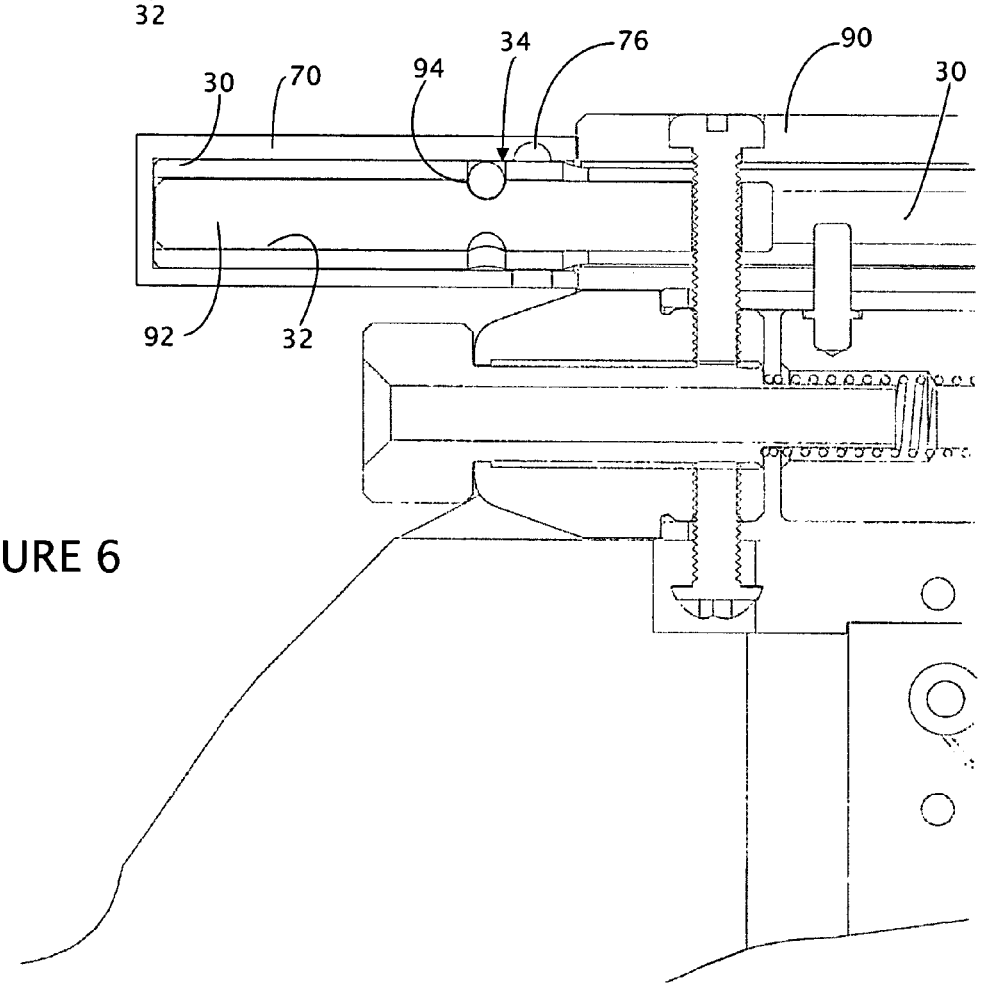
FIGURE 6

LINEAR BOLT MECHANISM FOR A GUN

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present disclosure relates to guns and particularly bolt action guns and more particularly to a linear bolt mechanism movable between an open position and a firing position independent of rotation of the bolt.

2. Description of Related Art

Many guns generally utilize a "rotary lock-up" bolt locking system in which a locking member portion of the bolt rotates about a centerline of the barrel, engaging and disengaging tabs or lugs with mating surfaces in the barrel or gun. The tabs, or lugs, traditionally have been integral components of the bolt head and are required to support the rearward axial load produced by the discharge force such as the firing of a shell or cartridge in the breech. As a result of this integral design, the entire bolt head assembly is required to rotate to engage and disengage the lugs. Many firearms further must incorporate an extractor to pull the shell or cartridge out of the breech when the bolt is opened, wherein the extractor is typically mechanically attached the bolt so as to rotate as an integral component of the bolt assembly.

U.S. Pat. No. 6,393,961 provides a straight-pull breechblock with rotating-boss locking mechanism for repeating weapons, having a breechblock sleeve which is guided in a breechblock housing and carries a bolt handle for the manual to-and-fro motion and in which, by means of a shaft, a breechblock head which bears locking bosses is mounted in a forcibly guided, rotatable manner, and which breechblock sleeve comprises a firing pin which is acted upon by a firing spring, which further serves to generate an angular momentum in order to rotate the breechblock head in the locking position into the locking chamber corresponding to the locking bosses.

However, the need remains for a bolt mechanism that is not handed or preferential. That is, there is a need for a bolt mechanism that can selectively open and close a breech of a gun without requiring rotational motion of the bolt, or a portion of the bolt assembly. The need also exists for a bolt mechanism that can selectively open and close a breech of a gun with equal left hand or right hand motions.

BRIEF SUMMARY OF THE INVENTION

A linear bolt mechanism for a gun is provided, wherein a bolt is moveable along a longitudinal axis relative to the breech between a firing position and a loading position, the bolt including a seating socket; a locking pin contacts the bolt, the locking pin moveable between a locking position precluding movement of the bolt along the longitudinal axis and a traveling position for movement of the bolt along the longitudinal axis; and an actuator is movably connected to the bolt along the longitudinal axis between a clamping position disposing the locking pin in the locking position and a release position, such that the actuator having a capture recess sized to dispose the locking pin in the travelling position in response to the actuator in the release position.

In one configuration, the bolt includes a locking rod, a breech portion, wherein an arm connects the locking rod and the breech portion, and the locking rod including the seating recess. It is further contemplated the locking rod, the breech portion and the arm of the bolt are integral.

The locking pin can move radially between the locking position and the traveling position.

The bolt and the actuator are selected such that the actuator can be moved along the longitudinal axis in a given direction relative to the bolt to assume an engaging position, with further movement of the actuator in the given direction imparting movement of the bolt along the longitudinal axis in the given direction.

A method is also provided for moving a bolt along a longitudinal axis relative to a breech in a gun, by sliding an actuator in a first direction along the longitudinal axis relative to the bolt to dispose a locking pin from a locking position fixing the bolt relative to the breech to a travel position; and translating the actuator in the first direction along the longitudinal axis to engage the actuator with the bolt and move the bolt along the longitudinal axis relative to the breech.

The method further contemplates translating the actuator in a second direction along the longitudinal axis opposite to the first direction to dispose the locking pin in the locking position and preclude movement of the bolt along the longitudinal axis.

BRIEF DESCRIPTION OF THE SEVERAL VIEWS OF THE DRAWING(S)

FIG. 1 is a perspective view of a gun incorporating the linear bolt mechanism.

FIG. 2 is an exploded perspective view of a portion of the gun of FIG. 1.

FIG. 3 is a cross sectional perspective view of a portion of the gun of FIG. 1.

FIG. 4 is a side elevational cross section of a portion of the gun of FIG. 1.

FIG. 5 is a perspective cross sectional view of the bolt.

FIG. 6 is a side elevational cross section of an actuator in a locked position.

DETAILED DESCRIPTION OF THE INVENTION

Figure 7:
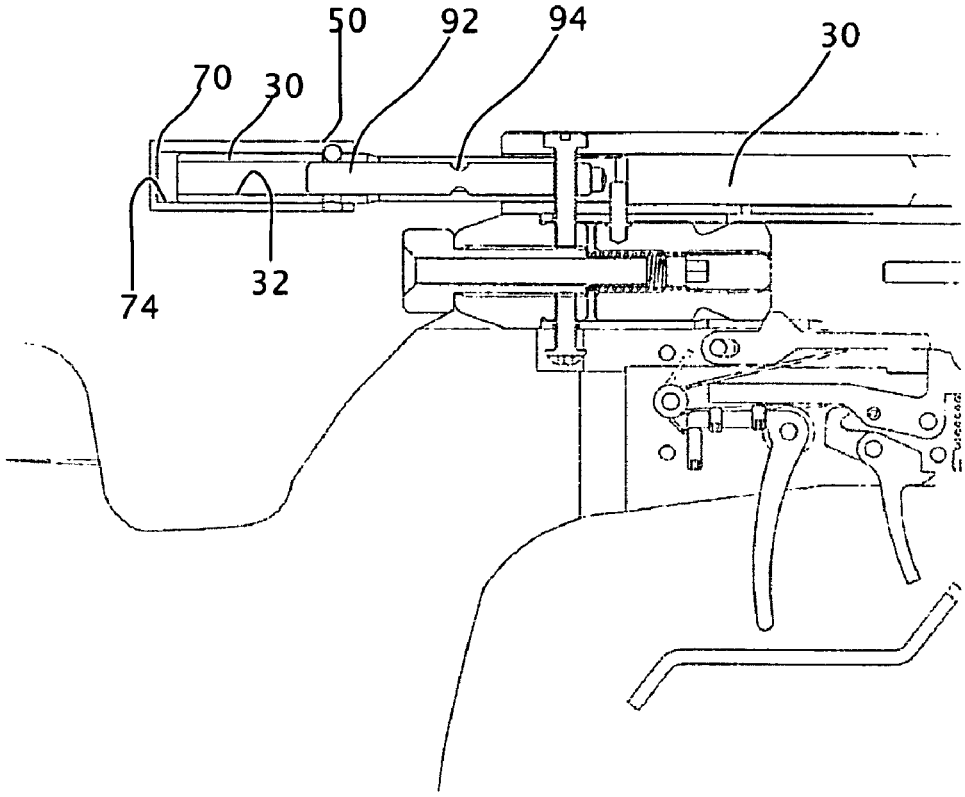
FIG. 7 is a cross sectional section of the bolt and the actuator in a retracted position.

As seen in FIG. 1, a linear bolt mechanism 10 is provided for use in conjunction with a gun 20. The term gun includes, but is not limited to a projectile launching weapon using a hollow, tubular barrel with a closable end for directing a projectile along the barrel to exit along a trajectory.

In one configuration, the gun is a bolt action gun. Bolt action guns are most often rifles, but there are bolt action shotguns and handguns as well.

Typically, the gun includes a stock or grip 22, a barrel 24, a trigger assembly 26, a breech 28 and a bolt 30.

The stock or grip 22 can be any of a variety of configurations depending on the intended operation of the gun, and provides for the holding and manipulation of the gun by the operator.

Similarly, the barrel 24 is configured as dictated by the intended operating parameters of the gun 20. For example, in a long gun the barrel 24 is relatively long such as 24 inches or more. Alternatively, if the gun 20 is a hand gun, such as a pistol, the barrel 24 may be on the order of six inches to 12 inches. The barrel 24 extends along a longitudinal axis, wherein the breech 28 is provided for disposing a projectile within the barrel for discharge.

The trigger assembly 26 is well known in the art and provides for the selective discharge of the projectile from the barrel 24. In certain constructions, the trigger assembly 26 provides an action resulting in the activation of an explosive charge to propel the projectile from the gun 20, and in other constructions the trigger assembly provides an action resulting in exposure of the projectile to a source of high pressure gas.

The breech 28 can be any of a variety of configurations, and is generally disposed at the rear of the barrel 24 to permit insertion of a projectile for discharge through the barrel.

The bolt 30 is movable between a first open or loading position which opens the breech 28 and a second closed or firing position to close the breech. As the bolt 30 is exposed to a motive force on the projectile, the bolt is secured or locked in the firing position when the projectile is fired from the gun 20. When the breech 28 is opened, a spent shell or casing is withdrawn and ejected, and a new projectile, such as a round or shell is placed into the breech and the bolt 30 is moved to the closed or firing position. Alternatively, if the projectile is discharged from the gun 20 by a renewable motive force, such as compressed gas, there may be no shell or casing associated with the projectile, thus the moving of the bolt 30 to the open or loading position provides for the introduction of a projectile in the breech 28.

Movement of the bolt 30 between the loading position and the firing position is along the longitudinal axis. In one configuration, the linear movement of the bolt 30 along the longitudinal axis to operably open or close the breech 28 is free of rotational movement about the longitudinal axis.

Referring to FIGS. 3, 4, 6 and 7, the linear bolt mechanism includes the bolt 30, a locking pin 50 and an actuator 70, which cooperate with a locking socket 94 fixed relative to the gun 20. The locking socket 94 can be located in any of a variety of components of the gun 20. For example, the locking socket 94 can be formed in a portion of the grip or stock 22, a breech housing 90, a breech plug 92 or other fixed portion of the gun. As seen in FIGS. 3, 4 and 6, the locking socket 94 is formed in the breech plug 92 as the plug extends rearward from the breech 28 and breech housing 90.

The bolt 30 is sized to extend from the breech 28 and includes a receiving sleeve 32 and a seating socket 34.

The receiving sleeve 32 is sized to slidably receive a portion of the gun that houses the locking socket 94, such as the breech plug 92 shown in FIGS. 3, 4, and 6. The receiving sleeve 32 has a dimension along the longitudinal axis sufficient to permit travel of the bolt 30 between the loading position and the firing position.

The seating socket 34 can be a single socket extending radially relative to the longitudinal axis. It has been found satisfactory to construct the seating socket 34 in the configuration of at least one radially extending aperture extending from the receiving sleeve 32.

The bolt 30 can also include (i) a retraction shoulder 36 for engaging the actuator upon movement of the actuator relative to the bolt in a rearward direction along the longitudinal axis and (ii) a driving shoulder 38 for engaging the actuator upon movement of the actuator in a forward direction along the longitudinal axis.

The locking pin 50 is moveable between a locking position precluding movement of the bolt 30 along the longitudinal axis and a travelling position for movement of the bolt along the longitudinal axis. The locking pin 50 is sized to be at least partially received in the locking socket 94 of the gun 20 in the locking position of the pin and spaced from the locking socket in the traveling position of the pin. In one configuration, the locking pin 50 is radially moveable between the locking position and the travelling position.

In one configuration, the locking pin 50 is a sphere sized to seat a portion, such as between 10% to approximately 90%, of the sphere within the locking socket 94.

Figure 8:
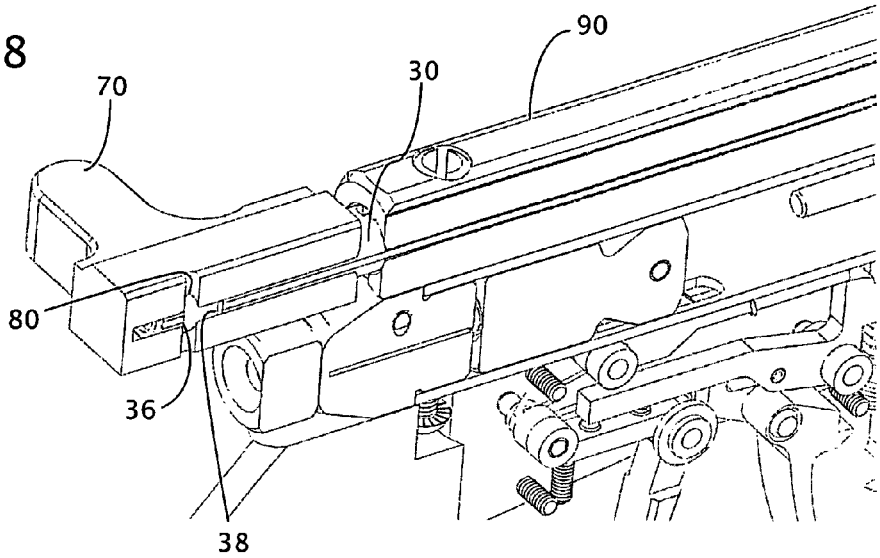
FIG. 8 is a perspective cross sectional view of the actuator retracting the bolt.
Figure 9:
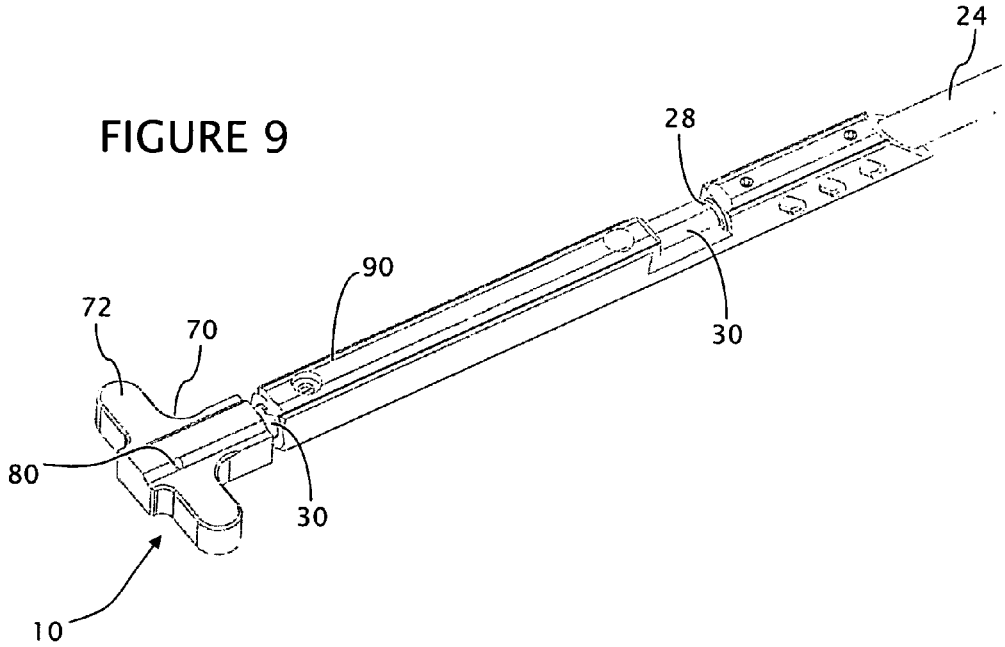
FIG. 9 is a perspective view of the linear bolt mechanism.
Figure 10:
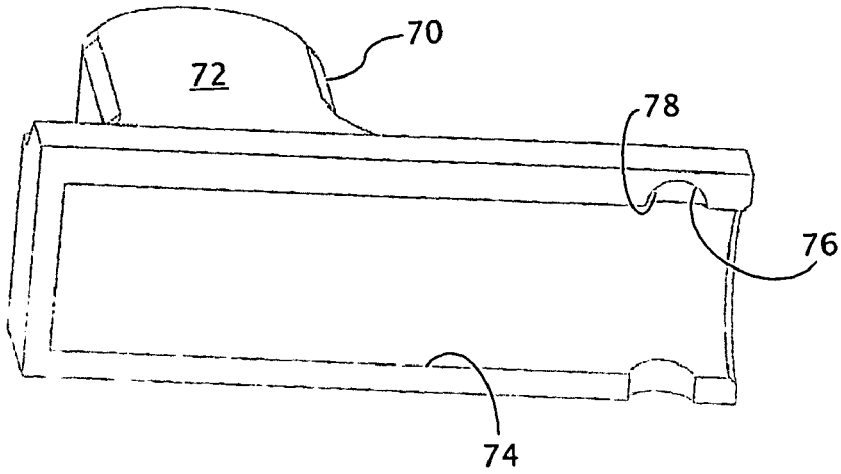
FIG. 10 is perspective view of the actuator.

As seen in FIGS. 8-10, the actuator 70 includes a handle portion 72 and a sleeve 74, wherein the sleeve is sized to receive a length of the bolt 30. The sleeve 74 is sized such that the actuator 70 is movably connected to the bolt 30 along the longitudinal axis between a clamping position and a release position.

The handle portion 72 defines an exposed surface of the actuator 70 for gripping by the operator for facilitating movement of the actuator along the longitudinal axis relative to the bolt 30. In one configuration, the handle portion 72 is generally symmetrical about the longitudinal axis. That is, the handle portion 72 is equally engageable by either the left hand or the right hand of the operator.

The actuator 70 includes a protrusion, shoulder, pin or step 80 which extends into the sleeve 74 to contact the retraction shoulder 36 and the driving shoulder 38 of the bolt 30 upon a predetermined relative motion between the bolt and the actuator. That is, the step 80 contacts the retraction shoulder 36 upon relative motion between the actuator 70 and the bolt 30 in a first direction along the longitudinal axis, and contacts the driving shoulder 38 upon relative motion between the actuator and the bolt in an opposite second direction along the longitudinal axis.

The actuator 70 includes a capture recess 76 sized to receive at least a portion of the locking pin 50 to permit the locking pin to be disposed in the travelling position in response to the actuator being disposed in the release position.

In one construction, the actuator 70 further includes a camming surface 78 adjacent to the capture recess. The camming surface 78 is selected to urge the locking pin 50 from the locking socket 94 in response to movement of the actuator 70 relative to the bolt 30 in a first direction along the longitudinal axis.

It is also contemplated that the locking pin 50 can be biased to one of the locking position and the travelling position. For example, a spring can be disposed between the locking pin 50 and the locking socket 94, such that upon aligning the capture recess 76 of the actuator 70 with the seating socket 34 of the bolt 30, the locking pin moves from the locking position to the travelling position and the locking pin moves with the actuator.

In operation, the locking pin 50 is in the locking position. In the locking position of the locking pin 50, a portion of the locking pin is engaged with the locking seat 94 and a remaining portion of the locking pin is engaged with the seating socket 34 of the bolt 30. Also, when in the locking position, the locking pin 50 does not engage the capture recess 76 of the actuator 70, thus relative motion between the actuator 70 and the bolt 30 is provided, in both directions along the longitudinal axis.

By engaging both the locking seat 94 (and hence the gun 20) and the seating socket 34 of the bolt 30, wherein the surface of the sleeve 74 of the actuator 70 retains the locking pin 50 in this position, the locking pin essentially fixes the bolt relative to the gun; thus disposing and retaining the bolt in the firing position.

When the actuator 70 is then slid along the longitudinal axis relative to the bolt 30 in a rearward direction (towards the rear of the gun 20 and away from the barrel 24), the camming surface 78 of the actuator 70 urges the locking pin 50 from locking socket 94 of the gun 20 (in which the locking pin is disposed in the locking position), to be then partly disposed within the capture recess 76 of the actuator 70 and partly disposed within the seating socket 34 of the bolt 30 (the travelling position). Thus, the locking pin 50 engages the actuator 70, by the capture recess 76 and the bolt by the seating socket 34, thereby causing bolt 30 to move relative to the breech 28.

As the locking pin 50 is moved from the locking position to the travelling position, movement of the bolt 30 relative to breech 28 and breech housing 90 is enabled. The actuator 70 travels rearward to engage the pin 80 with the retraction shoulder 36 of the bolt 30. Continued rearward movement of the actuator 70 along the longitudinal axis moves the bolt 30 relative to the gun 20 and disposes the bolt from the closed position to the open position.

Once the bolt 30 is in the open position, a new projectile can be disposed in the breech 28.

The actuator 70 is then moved along the longitudinal axis in the forward direction, and moves relative to the bolt 30. The stop or pin 80 of the actuator 70 then engages the driving shoulder 38 of the bolt 30 and in conjunction with the locking pin 50 engaging the seating socket 34 and the capture recess 76, the bolt is then linearly translated along the longitudinal axis in the same forward direction as the actuator.

Upon the bolt 30 reaching the closed position, the capture recess 76, the seating socket 34 of the bolt, and the locking socket 94 are aligned at a common position along the longitude axis. With this alignment, the locking pin 50 moves from engaging the capture recess 76 and the seating socket 34 to engaging the locking socket 94 and the seating socket 34, thereby locking the bolt 30 in the closed position.

Continued forward movement of the actuator 70 relative to the bolt 30 causes the locking pin 50 to slidingly contact the sleeve 74 and urge the locking pin into the locking socket 94.

Continued forward movement of the actuator 70 relative to the bolt 30 wedges the locking pin 50 in the locking position and the retains the actuator in the forward most or firing position.

Thus, the linear bolt mechanism 10 provides for the opening and closing of the breech 28 through linear motions along the longitudinal axis, without requiring rotation of any of the components about the longitudinal axis. That is, the cycling of the bolt 30 from the firing position, to the loading position and back to the firing position is free of rotational motion of the bolt 30 or the actuator 70 about the longitudinal axis. As the bolt and all associated motion with the bolt cycling between the firing position and the loading position is independent of any rotation about the longitudinal axis, the linear bolt mechanism 10 is operationally non-handed.

Although the bolt 30 has been set forth as including the retraction shoulder 36 and the driving shoulder 38 with the actuator 70 including the pin 80, it is contemplated the actuator 70 can include the shoulder and the driving shoulder, while the bolt 30 includes the pin.

The foregoing embodiments are representative embodiments, and are provided for illustrative purposes. The embodiments are not intended to limit the scope of the invention. Variations and modifications are apparent from a reading of the preceding description and are included within the scope of the invention. The invention is intended to be limited only by the scope of the accompanying claims.

The invention claimed is:

1. A gun having a breech, the gun comprising:

(a) a bolt moveable along a longitudinal axis relative to the breech between a firing position and a loading position, wherein the bolt includes a locking rod, a breech portion and an arm connecting the locking rod and the breech portion, the locking rod including a seating socket;

(b) a locking pin contacting the bolt, the locking pin moveable between a locking position precluding movement of the bolt along the longitudinal axis and a traveling position for movement of the bolt along the longitudinal axis; and (c) an actuator movably connected to the bolt along the longitudinal axis between a clamping position disposing the locking pin in the locking position and a release position, the actuator having a capture recess sized to dispose the locking pin in the traveling position in response to the actuator being in the release position.

2. The gun of claim 1, wherein the locking rod, the breech portion and the arm are integral.

3. The gun of claim 1, wherein the locking pin moves radially between the locking position and the traveling position.

4. The gun of claim 1, wherein one of the actuator and the bolt includes a stop for engaging a remaining one of the actuator and the bolt to limit movement of the actuator along the longitudinal axis relative to the bolt.

5. The gun of claim 1, wherein the actuator is moveable along the longitudinal axis in a given direction to a bolt engaging position, with further movement of the actuator in the given direction imparting movement of the bolt along the longitudinal axis in the given direction.

6. The gun of claim 1, wherein the locking pin is a sphere.

7. The gun of claim 1, wherein one of the actuator and the bolt includes a retraction shoulder and a driving shoulder, and a remaining one of the actuator and the bolt includes a stop sized to contact at least one of the retraction shoulder and the driving shoulder.

8. The gun of claim 1, wherein the bolt includes a receiving sleeve, the receiving sleeve receiving a portion of the gun having a locking socket for engaging the locking pin in the locking position.

9. A method of moving a bolt along a longitudinal axis relative to a breech in a gun, the method comprising:

(a) translating an actuator in a first direction along the longitudinal axis relative to the bolt, the bolt includes a locking rod, a breech portion and an arm connecting the locking rod and the breech portion, to dispose a locking pin from a locking position fixing the bolt relative to the breech to a traveling position; and (b) further translating the actuator in the first direction along the longitudinal axis to engage the actuator with the bolt and move the bolt with the actuator along the longitudinal axis relative to the breech.

10. The method of claim 9, further comprising translating the actuator in a second direction along the longitudinal axis opposite to the first direction to dispose the locking pin in the locking position and preclude movement of the bolt along the longitudinal axis.

11. The method of claim 10, further comprising translating the actuator in the second direction along the longitudinal axis to engage a detent between the bolt and the actuator.

12. The method of claim 9, wherein disposing the locking pin from the locking position moves the locking pin transverse to the longitudinal axis.

13. The method of claim 9, wherein sliding an actuator in a first direction along the longitudinal axis relative to the bolt to dispose a locking pin from a locking position fixing the bolt relative to the breech to a travel position contacts a camming surface of the actuator with the locking pin.

14. The method of claim 9, further comprising disposing a portion of the locking pin in a capture recess of the actuator upon disposing the locking pin from the locking position.

15. The method of claim 9, further comprising providing a shoulder on the bolt for engaging the actuator with the bolt upon translation of the bolt in the first direction.

16. The method of claim 9, further comprising (a) translating the actuator in a second direction along the longitudinal axis opposite to the first direction to dispose the locking pin in the locking position and preclude movement of the bolt along the longitudinal axis and (b) translating the actuator in the second direction along the longitudinal axis after disposing the locking pin in the locking position to retain the locking pin relative to the locking seat.

17. A gun having a breech, the gun comprising:

(a) a bolt moveable along a longitudinal axis relative to the breech between a firing position and a loading position, the bolt including a seating socket;

(b) a locking pin contacting the bolt, the locking pin moveable between a locking position precluding movement of the bolt along the longitudinal axis and a traveling position for movement of the bolt along the longitudinal axis; and (c) an actuator movably connected to the bolt along the longitudinal axis between a clamping position disposing the locking pin in the locking position and a release position, the actuator having a capture recess sized to dispose the locking pin in the traveling position in response to the actuator being in the release position, the locking pin in the traveling position cooperatively engaging the actuator and the bolt.

18. The gun of claim 17, wherein the bolt includes a locking rod, a breech portion and an arm connecting the locking rod and the breech portion.

19. The gun of claim 17, wherein one of the actuator and the bolt includes a retraction shoulder and a driving shoulder, and a remaining one of the actuator and the bolt includes a stop sized to contact at least one of the retraction shoulder and the driving shoulder.

20. The gun of claim 17, wherein the actuator can move relative to the bolt with the locking pin in the locking position.

* * * * *